US007178566B2

(12) United States Patent
Schaefer

(10) Patent No.: US 7,178,566 B2
(45) Date of Patent: Feb. 20, 2007

(54) PROCESS AND APPARATUS FOR PRODUCING VENEER STRIPS, CHIPPED WOOD OR THE LIKE

(75) Inventor: Karl Schaefer, Lechbruck am See (DE)

(73) Assignee: Inter-Wood-Maschinen KG, Lechbruck am See (DE)

( * ) Notice: Subject to any disclaimer, the term of this patent is extended or adjusted under 35 U.S.C. 154(b) by 337 days.

(21) Appl. No.: 10/753,083

(22) Filed: Jan. 8, 2004

(65) Prior Publication Data

US 2004/0250948 A1 Dec. 16, 2004

(30) Foreign Application Priority Data

Jan. 9, 2003 (DE) ..... 103 00 440

(51) Int. Cl.
*B27C 9/00* (2006.01)
*B27L 5/02* (2006.01)
*B27L 7/00* (2006.01)
*B27M 1/08* (2006.01)

(52) U.S. Cl. ..... 144/369; 144/245.2; 144/246.1; 144/248.5

(58) Field of Classification Search ..... 144/242.1, 144/245.1, 245.2, 250.13, 250.26, 250.25, 144/245.5, 246.1, 248.5, 248.6, 369, 373, 144/176; 241/92, 93, 223, 245, 296, 28
See application file for complete search history.

(56) References Cited

U.S. PATENT DOCUMENTS 3,913,643 A * 10/1975 Lambert ..... 144/172
4,222,531 A * 9/1980 Thumm ..... 241/281
5,070,918 A * 12/1991 Pallmann ..... 144/172
5,299,610 A * 4/1994 Sentagnes et al. ..... 144/370
5,762,122 A * 6/1998 Rice, Sr. ..... 144/373
6,035,910 A * 3/2000 Schaefer ..... 144/369

OTHER PUBLICATIONS

Holz und Kunststoff, "Spankultur", pp. 49-52 (May 2001).
Thole et al., "The Density and Strength of Wood-Based Materials Require a Great Deal of Attention in the Production of Particles", The Culture of Particles, (6 pgs).
DE-AS 1104676, ( 3 pgs) Apr. 1961.

* cited by examiner

*Primary Examiner*—Bena Miller
(74) *Attorney, Agent, or Firm*—Whitham, Curtis, Christofferson & Cook, PC

(57) ABSTRACT

The invention relates to a process and an apparatus for producing veneer strips, chipped wood or the like, individual pieces of wood being joined together, with grains parallel, to form a group and then a multiplicity of such groups being arranged one behind the other, with grains parallel, to form a closely packed line, whereupon this line is then fed in its longitudinal direction, transverse to the wood-grain direction, to a chipping tool. In order, during the chipping operation, largely to prevent the accumulation of coarse chips, it is proposed according to the invention that the leading group conveyed up against the chipping tool is subjected, via the following group butting against it, to a longitudinal compressive force which acts in the longitudinal direction of the line, which exceeds the relative cutting force to which the leading group is subjected by the chipping tool, and which is largely absorbed by the leading group, which, by way of its advancement speed being braked, acts as an abutment.

27 Claims, 5 Drawing Sheets

PROCESS AND APPARATUS FOR PRODUCING VENEER STRIPS, CHIPPED WOOD OR THE LIKE

The present invention relates to a process and an apparatus for producing veneer strips, chipped wood or the like, individual pieces of wood, which may be round timber or boards, being joined together to form a group, a multiplicity of such groups forming a closely packed line, and this line being fed to a chipping tool.

Such a process and such an apparatus for producing veneer strips from groups of boards are known from U.S. Pat. No. 6,035,910. In this document, sawn timber is used to form groups which are chipped by a knife disk to form veneer strips of a predetermined length, width and thickness. The groups are arranged closely one behind the other on a feed means which conveys the groups continuously to the knife disk.

This process and this apparatus can be used to produce veneer strips of a predetermined length, width and thickness from groups of boards which are then processed further to form structural elements such as veneer-strip panels and beams or to form particle boards or OSBs.

The strength of such structural elements depends mainly on the homogeneity of the veneer strips used. Since, during the production of the latter, coarse chips, i.e. excessively thick offcuts, splinters, short pieces, etc. unavoidably accumulate, and these coarse chips are also processed in the structural elements, the strength of said veneer strips decreases rapidly (see, in this respect, also DE Z: Holz-und Kunststoffverarbeitung [Wood and plastics processing], issue 5, 2001, pages 49 to 52). As a result, the structural element has to be produced with a considerably higher strength, in order for the necessary strength values to be achieved even in the least favorable regions, i.e. in the regions in which coarse chips are present in the structural element. As a result, although the structural element achieves the necessary strength values at each location, there are also regions present in which the necessary strength values may have been exceeded by a multiple. This is uneconomic, however, since material is wasted unnecessarily if, e.g. in order to ensure the minimum strength, the structural elements are produced to be thicker than necessary or with a higher relative density.

The production of coarse chips in the form of splinters and excessively thick offcuts cannot be avoided by any of the chippers which have been known up until now. Even when long boards are pushed into a displaceable knife ring, as is explained in U.S. Pat. No. 6,035,910, coarse particles are formed even if these boards are pushed closely together at their longitudinal edges to form a group. The production-induced width tolerances in these boards do not allow adhesion over the entire length. The fines are sifted out in a known manner; for coarse chips, this is only possible to an insufficient extent, as is known, in the industrial sector. Even small quantities of splinters and excessively thick pieces considerably reduce the bending strength, the modulus of elasticity and the transverse tensile strength of the resulting panels or beams, this quite particularly being the case with thin panels.

If it were possible to prevent coarse chips from being generated during the production of the veneer strips, chipped wood or the like, it would be possible for structural elements comprising veneer strips, chipped wood and the like to be produced to better effect and in a more cost-effective manner.

The object of the invention is thus to provide a process and an apparatus in which barely any coarse chips accumulate.

This object is achieved, in the case of a process for producing veneer strips, chipped wood or the like, individual pieces of wood being joined together, with grains parallel, to form a group and then a multiplicity of such groups being arranged one behind the other, with grains parallel, to form a closely packed line, whereupon this line is then fed in its longitudinal direction, transverse to the wood-grain direction, to a chipping tool, in that the leading group conveyed up against the chipping tool is subjected, via the following group butting against it, to a longitudinal compressive force which acts in the longitudinal direction of the line, which exceeds the relative cutting force to which the leading group is subjected by the chipping tool, and which is largely absorbed by the leading group, which, by way of its advancement speed being braked, acts as an abutment.

As a result of this configuration, it is possible effectively to prevent the formation of coarse chips during the production of veneer strips, chipped wood or the like. If the individual groups, during continuous advancement, are held together firmly enough for the force which presses together at least the groups located immediately upstream of the chipping tool to exceed the cutting force, the rest of each group is reliably retained such that the groups can be fully chipped without coarse chips also accumulating in the process.

The veneer strips, chipped wood or the like produced in accordance with the process according to the invention explained above is/are thus free of coarse chips and can be used to produce high-quality wood particle beams or wood particle boards, which, with such products having comparatively low relative densities, has not been possible up until now. Production thus takes place with the amount of materials used being reduced and costs being lowered.

It is expedient according to the invention if at least the front two groups in the line are pressed against one another, under the action of the longitudinal compressive force, to such a pronounced extent as to produce, between these front two groups, an adhesion which exceeds the abovementioned cutting force.

Furthermore, it is advantageous if, in order to increase the adhesion between successive groups, the mutually facing longitudinal edges of the latter are moistened, preferably immediately before the groups are formed.

According to a specific embodiment, the adhesion exceeds the relative cutting force at least in a region just upstream of the chipping tool. As a result of this configuration, the relatively high level of adhesion which is necessary between the groups is only provided wherever it is necessary. This is indeed expedient, but requires relatively high control-related outlay.

According to an alternative embodiment, it is thus possible for the adhesion to be built up over the entire length of the line.

According to a further advantageous development, it is also possible for the adhesion to increase continuously or discontinuously in the feed direction. This makes it possible to save energy since the necessary adhesion increases gradually to the necessary value. Moreover, in the case of this configuration, the groups are subjected to gradually increasing adhesion, which, as the feed operation continues, results in closer packing of the groups.

The abovementioned longitudinal compressive force may be produced by conveying elements which act on at least one line-forming group in the conveying direction of the line. It is possible here for conveying elements to act with different advancement forces on a plurality of line-forming groups. Under the action of these advancement forces, the second group from the front in the line is pressed against the rear side of the first group, the advancement movement of which is subjected to pronounced braking, as a result of which the desired high longitudinal compressive force can build up.

In order to fix the position of the group located immediately upstream of the chipping tool, this group may additionally be subjected to a preferably preselectable vertical compressive force which acts over the height of the group. Furthermore, this front group may additionally be subjected to a preferably preselectable horizontal force which acts over the width of the group. It is expedient here, however, if the vertical and/or horizontal force is eliminated at a distance from the chipper tool which corresponds approximately to once to twice the thickness of the veneer strips, chipped wood or the like which is/are to be produced.

In order to produce veneer strips of a predetermined width and largely equal thickness, it is expedient if each group is formed from board portions which are positioned flatly one above the other and of which the board thickness corresponds to the width of the veneer strips which are to be produced (as is also described in U.S. Pat. No. 6,035,910).

Since there may be marked differences in the compressibility of the different types of wood used, it is expedient if the feeding speed of the front line end is abruptly slowed down whenever the separating joint between two successive groups approaches the chipping tool. It is thus possible effectively to prevent coarse chips from being produced because, as a result of the advancement speed being abruptly slowed down, the final remnant of the leading group is fibrillated to form fines. Although this results in a slight increase in the quantity of fines, this is not particularly disadvantageous since fines can easily be sifted out of the useful material. It should be the case here that the region in which the feeding speed is slowed, in dependence on the type of wood, is only a few millimeters.

The object mentioned in the introduction is further achieved by an apparatus having a chipping tool, a feed means for a line which is to be chipped and is made up of a multiplicity of groups of individual pieces of wood arranged closely one behind the other, and having a conveying arrangement which conveys the line in its longitudinal direction toward the chipping tool and comprises the conveying elements which subject the line to an advancement force in the advancement direction such that the front group in the line, which runs up in a braked manner against the chipping tool, is subjected, via the group following it, to a longitudinal compressive force which exceeds the relative cutting force to which the leading group is subjected by the chipping tool.

It is possible here for conveying elements to act with different advancement forces on the groups, the conveying elements which act on the group which runs up against the chipping tool causing this group to be braked in relation to following groups, with the result that the leading group has the effect of a run-on brake.

It is possible for the conveying elements to be designed as chain, belt or roller conveyers, to comprise a multiplicity of overlapping conveying chains and, moreover, to form the base and/or the sides and/or a top covering of the above-mentioned feed means, and they can be driven separately from one another and at different speeds. It is possible here for the conveying elements to be controlled such that the necessary contact pressure between adjacent groups is produced either over the entire length of the line or just in the region immediately upstream of the chipping tool.

In order to ensure uniform force transmission, the conveying elements are preferably provided on both sides of the feed means and may be designed as rollers, where the top and bottom conveying elements are designed as belt conveyers.

If the overlapping conveying chains are driven at different speeds, these speeds decrease as the conveying chains are arranged more closely to the chipping tool. The contact pressure between adjacent groups immediately upstream of the chipping tool can thus be produced easily and without high control-related outlay.

The groups may be subjected, immediately upstream of the chipping tool, to the action, in a vertical direction, of a pressure-exerting bar, of which the pressing force can be preselected. This improves the guidance and securing of the groups immediately upstream of the chipping tool. It is also possible to provide contact-pressure bars which are arranged immediately upstream of the chipping tool, on both sides of the feed means, can be driven horizontally, transversely to the feed means, and are intended for acting on the leading group with a horizontal force. Here too, it is expedient if the corresponding contact-pressure forces can be preselected. Overall, this arrangement has the advantage that any relatively small splinters which may break off cannot pass between the gap between the cutting edge of the chipping tool and a stump cutter; rather, these relatively small splinters are fibrillated to form fines, which can be sifted out in a known manner.

According to a preferred configuration, the feed means forms an angle with a horizontal and/or a vertical, with the result that the groups can be fed to the chipping tool at an angle. This makes it possible to produce a stable abutment precisely for the final regions of a group.

According to an advantageous development, the feed means may be subdivided by at least one central partition wall running in the feed direction. As a result of this configuration, depending on the number of partition walls, it is possible for two or even more rows of groups to be fed parallel and adjacent to one another. If a plurality of rows of groups are fed, it obviously has to be ensured that, in each row, at least the groups located immediately upstream of the chipping tool are held together by a force which exceeds the relative cutting force to which the group which is to be chipped in each case is subjected by the chipping tool. This may be achieved, for example, by a suitable arrangement of the feed conveyors.

In order to ensure continuous chipping, a feed conveyor for transferring the groups to the feed means is preferably provided upstream of the feed means. If the process according to the invention and the apparatus according to the invention are operated discontinuously, it is possible to dispense with this feed conveyor.

If pieces of wood which are obtained, for example, from slabs and splinters by being cut to a length which is appropriate for charging purposes are fed, then these pieces of wood, even as they are supplied to the upstream feed conveyor, have to be oriented with grains parallel, and with the cavities which are initially formed between them being reduced in size in the process. This can take place in a known manner by so-called orienting plates which produce lateral movements and/or by a corresponding vibrating section. It is only following this feed conveyor that such pieces of wood are taken up, for example, by the advancement chains arranged above and beneath the groups. It is possible for these advancement chains, pressed on under spring loading or by hydraulic action, to adapt themselves elastically to differences in height which are still present between the groups. The pressure-exerting bar, of which the contact-pressure force can be preselected, automatically assumes the most advantageous height position in each case via a corresponding control means.

The chipping tool is preferably a disk-type chipper. It is expedient here if a stationary bridging bar is arranged immediately upstream of the disk-type chipper, just a few tenths of a millimeter upstream of the rotating knives thereof. If the leading group, forming the front end of the line, is braked, for example via circulating chains, then the braking force thereof, ceases when the deflection of these chains commences. However, the abovementioned, vertically drivable pressure-exerting bar then assumes the task of acting on this leading group, it no longer being possible for any more pressure to be applied, as this leading group is en route to being cut, at a distance which corresponds to once to twice the strip or chipped-wood thickness. The aim of avoiding coarse chips which is sought according to the invention is assisted in an effective manner by this measure.

It is also possible, however, for the chipping tool to be a stationary knife-ring flaker. It is nevertheless then necessary to deflect the groups fed in the chipping space through 90° in order that they can be cut with cutting edges parallel.

Further features, configurations and advantages of the process according to the invention and of the apparatus according to the invention can be gathered from the exemplary embodiments described hereinbelow. In the figures.

Figure 1:
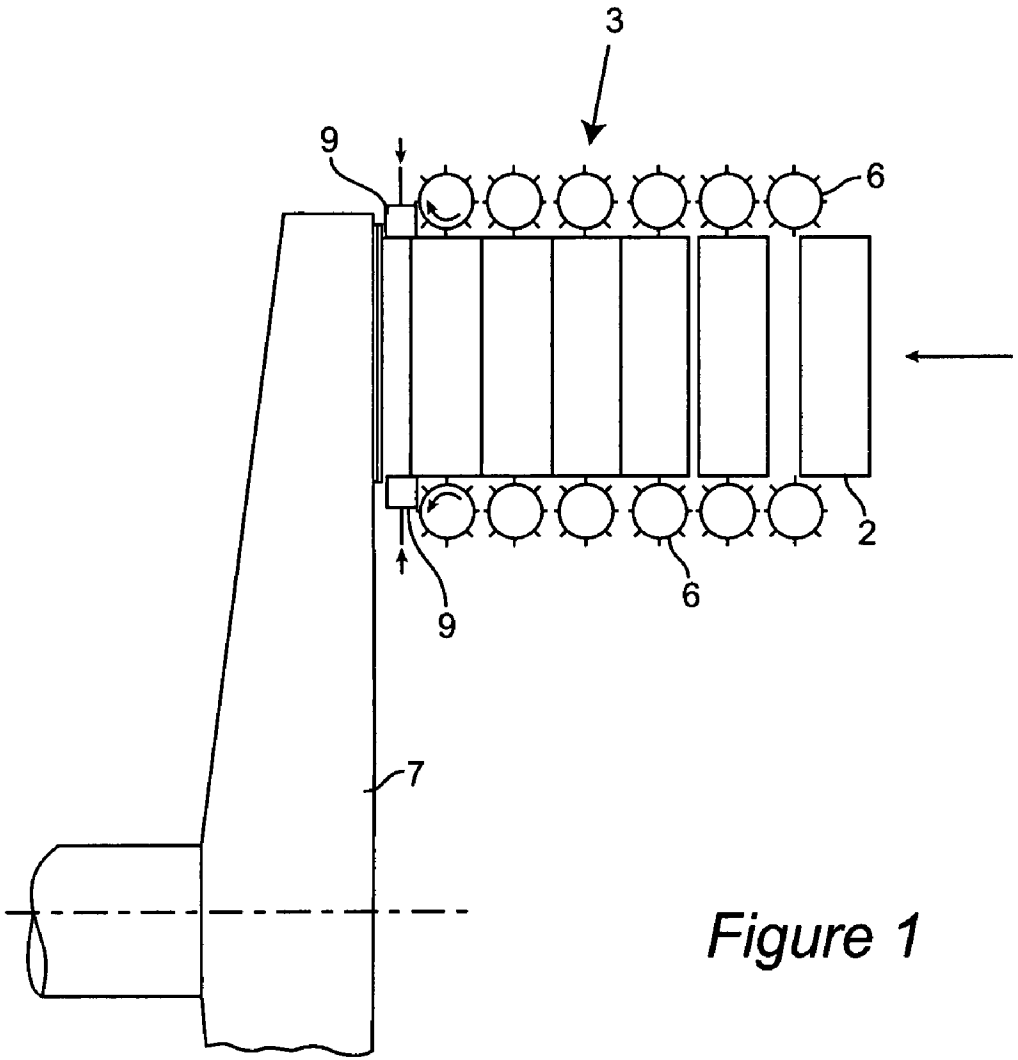
FIG. 1 shows, in a schematic illustration, a plan view of an apparatus according to the invention with a disk-type chipper as chipping tool.
Figure 2:
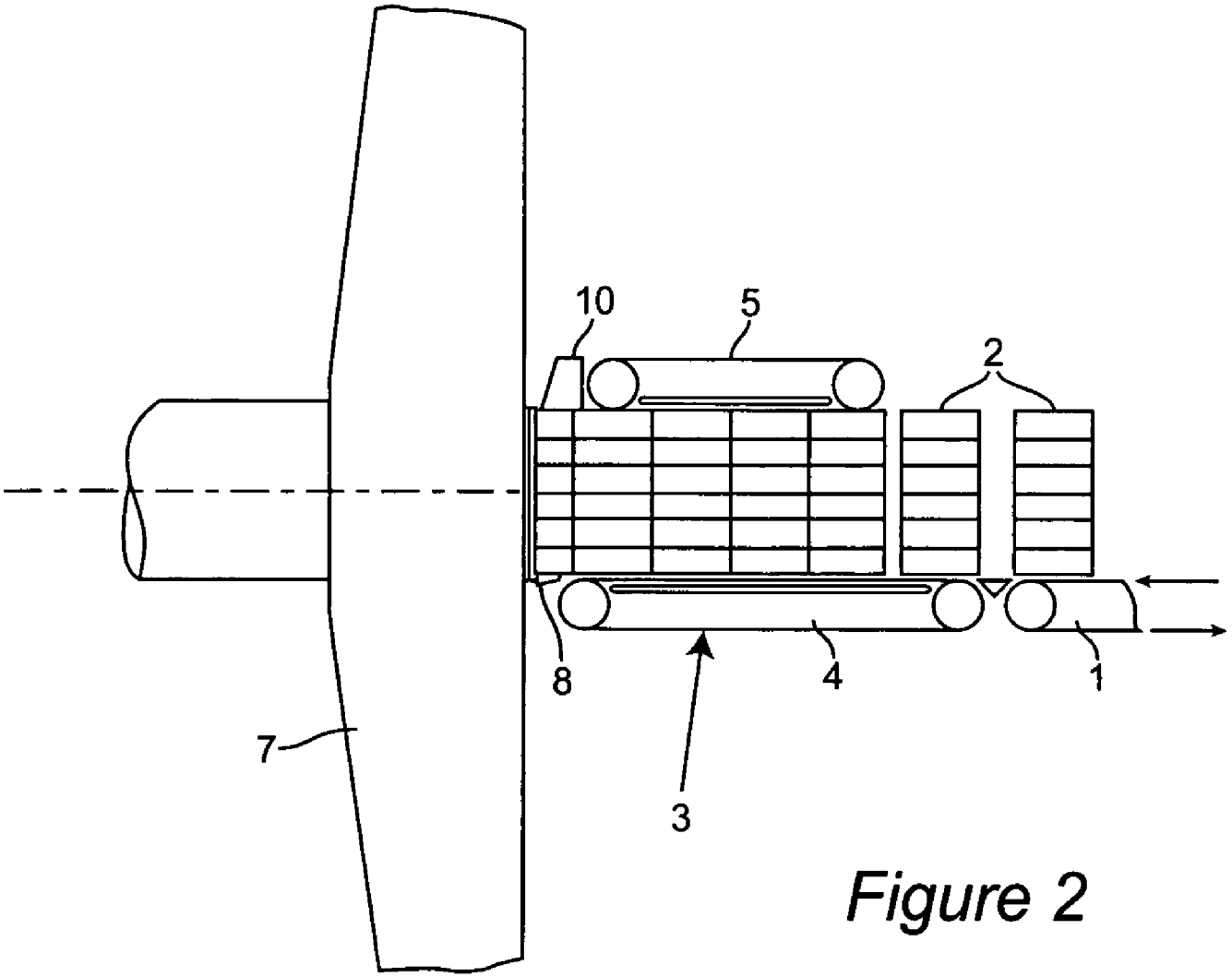
FIG. 2 shows a side view of an apparatus according to the invention with a disk-type chipper.

Via a feed conveyor 1, which is only schematically indicated in FIG. 2, groups 2 of boards, which have previously been positioned in layers one above the other, pass to a feed means 3. In the illustrated exemplary embodiment according to FIG. 2, this feed means 3 comprises a bottom feed conveyor 4, which is arranged beneath the groups 2, and a top feed conveyor 5, which is arranged above the groups 2. In the exemplary embodiment illustrated, the two feed conveyors 4, 5 are designed as a circulating belt. Moreover, advancement elements 6 are arranged on both sides of the feed means 3, these advancement means assisting the advancement of the groups 2 and ensuring tilt-free advancement.

Figure 4:
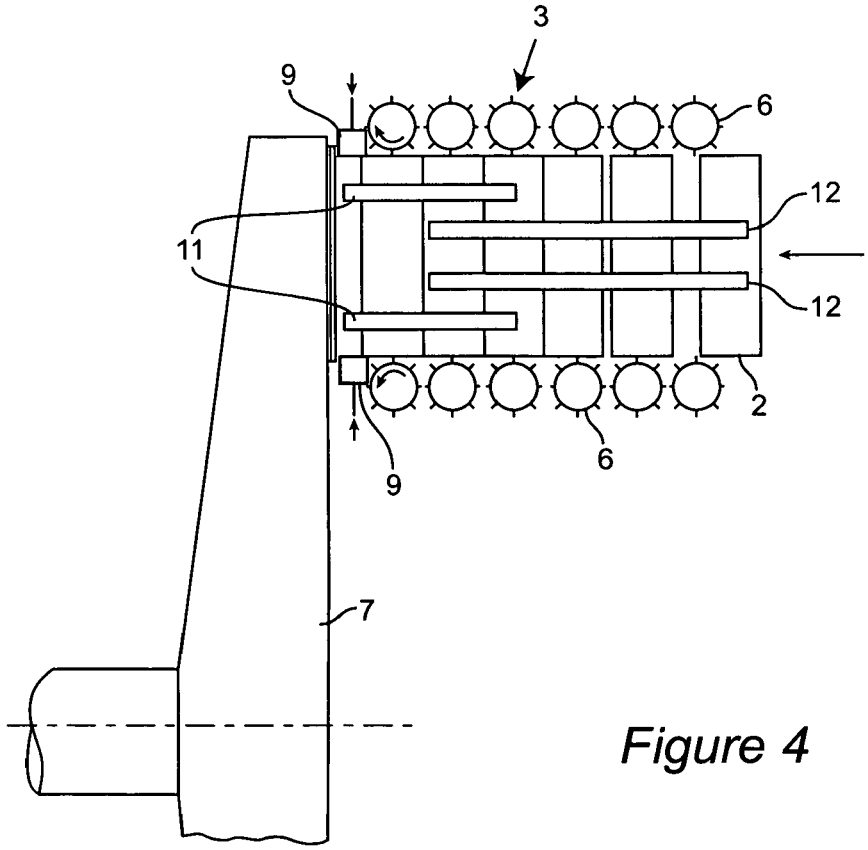
FIG. 4 shows, in an illustration according to FIG. 1, overlapping chain conveyors which act on the top side of the groups.
Figure 5:
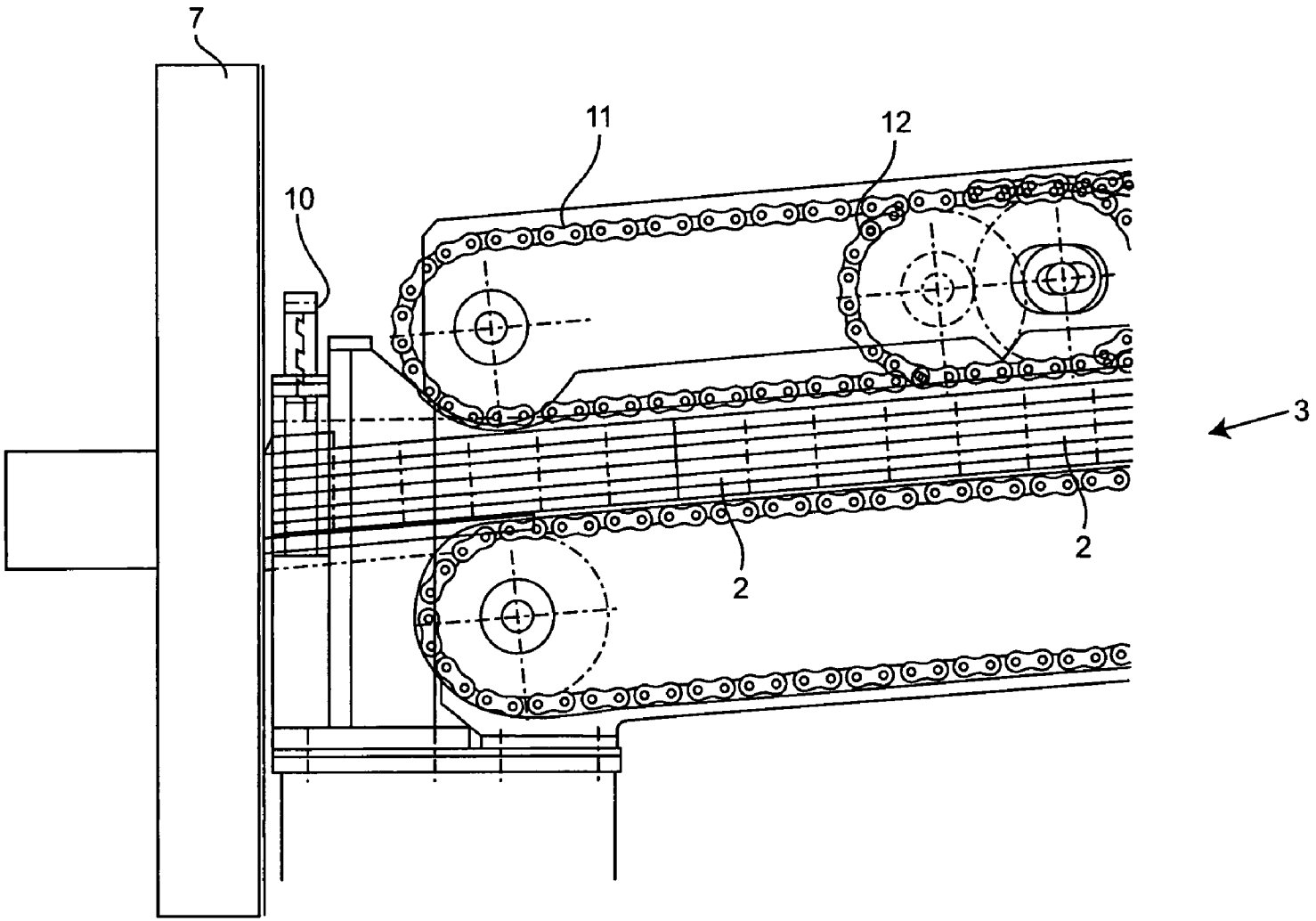
FIG. 5 shows a side view of a line, formed by groups, being fed obliquely to the chipping tool.

All the previously mentioned conveying elements may be designed, in a known manner, as chain, belt or roller conveyors which, via corresponding control means, ensure the uniform advancement of the line, which is formed by the groups. They may also be formed from rollers fitted with spikes or knives, which are known per se, and/or from continuously operating walking beams. It is possible here to provide a plurality of overlapping conveying elements on one or more sides of the groups 2. Thus, for example, FIGS. 4 and 5 show overlapping chain conveyors 11, 12 acting on the top side of the groups 2.

If a sufficient force has already been applied to the groups 2 by the feed conveyors 4, 5, it is possible to dispense with the lateral advancement element 6, these then being replaced by fixed side walls.

The feed conveyors 4, 5 and the advancement element 6 of the feed means 3 operate synchronously and at a regulatable advancement speed, which is coordinated with the required thickness of the veneer strips, chipped wood or the like which is/are to be produced.

Furthermore, the feed conveyors 4, 5 and the advancement elements 6 of the feed means 3 operate such that they produce a force which is directed, in the longitudinal direction of the feed means 3, onto the chipping tool, illustrated as a disk-type chipper 7, and which is dimensioned such that the individual groups 2 are pressed against one another firmly enough for the adhesion between two successive groups 2 to be greater than the relative cutting force to which the group 2 which has just been chipped is subjected by the knives of the chipping tool. This can take place, for example, such that the feed conveyors 4, 5 and the advancement elements 6 cause the individual groups 2 to be accumulated on the feed means 3, as a result of which the groups 2 are pressed firmly against one another.

In the front region of the advancement elements 6, immediately upstream of the disk-type chipper 7, a stationary bridging bar 8 is provided, as a bearing surface for the group 2 which is to be chipped, at a distance of approximately 0.3 mm upstream of the rotating knives (not illustrated specifically in the drawing) of the disk-type chipper 7. In the vertical direction, a pressure-exerting bar 10 presses the groups 2 together from above. In addition, referring to FIGS. 3 and 4, horizontally movable bars 9 are provided immediately upstream of the chipping tool 7, on both sides of the feed means, which can be driven horizontally, transversely to the feed means, and are intended for acting on the leading group 2 with a horizontal force. It is advantageous if the corresponding contact pressure can be pre-selected. Overall, the arrangement has the advantage that any relatively small splinters which may break off cannot pass between the gap (not numbered) between the cutting edge of the chipping tool and a stump cutter. Instead, these relatively small splinters are fibrillated to form fines, which can be sifted out in a known manner.

In order, according to the invention, largely to avoid the production of coarse chips, it is sufficient if the adhesion, which is preferably to be greater than the relative cutting force to which the respectively chipped group 2 is subjected, only acts between two groups 2 located immediately upstream of the chipping tool. However, it is also possible, in accordance with the invention, for the adhesion to act over the entire length of the line of groups 2 or to build up continuously or discontinuously over part of the length or the entire length of the line until it reaches the necessary value.

Figure 3:
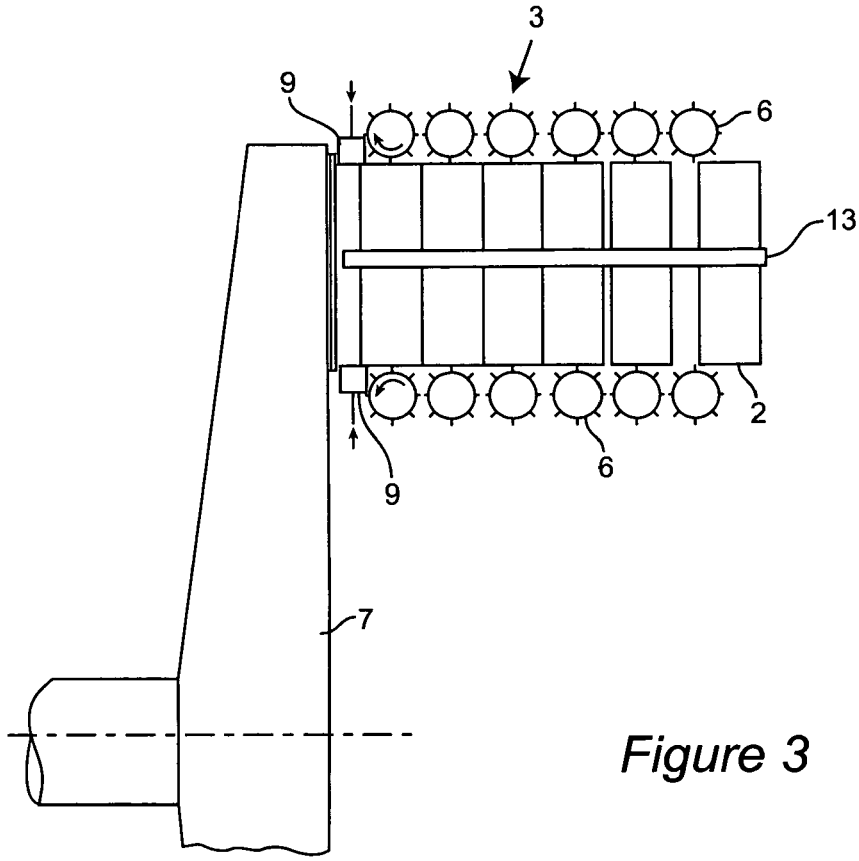
FIG. 3 shows, in an illustration according to FIG. 1, a group-feed means with a central partition wall.

If it is intended, instead of just one line of groups, for simultaneously, for example, two lines of groups to be fed, in the feed means 3, parallel to one another to the disk-type chipper 7, it is possible for the feed means 3, according to FIG. 3, to be subdivided by a central partition wall 13 running in the feed direction.

Figure 6:
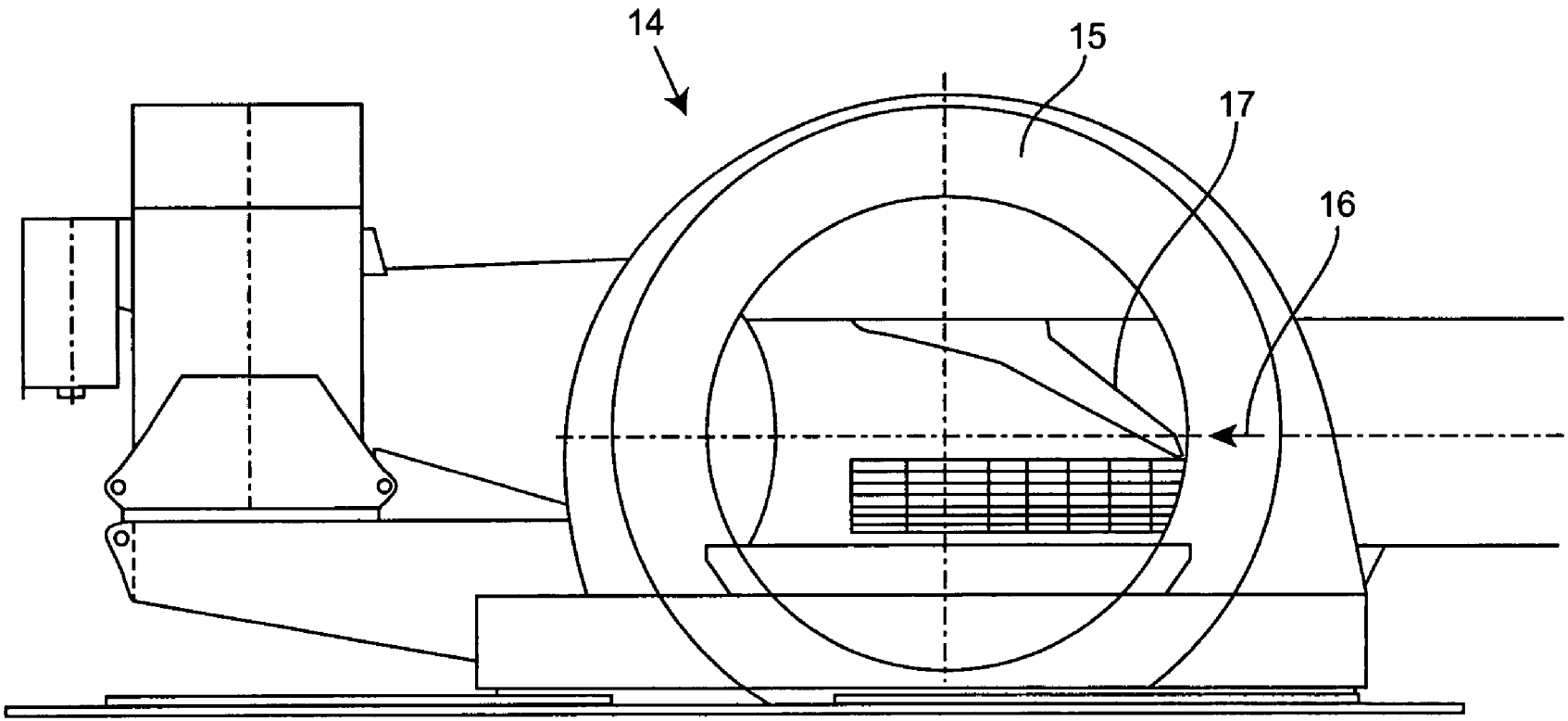
FIG. 6 shows an end view of a ring flaker.

FIG. 6 shows a chipping tool designed as a knife-ring flaker 14. Here, the knife ring 15 is used to cut, in arrow direction 16, the groups 2 fed to it. In this case, guide plates 17 which rest on the groups 2, and only act thereon by way of their weight, constantly move back on the top group surfaces.

The invention claimed is:

1. A process for producing veneer strips or chipped wood, comprising:

forming a plurality of wood groups, each of said wood groups comprising a plurality of board portions positioned in a stacked manner, with their respective grains parallel to one another and to a given grain direction;

arranging a plurality of said wood groups one behind the other in a line extending in a longitudinal direction, with their respective grains parallel to said grain direction, to form a closely packed line of said wood groups, comprising a leading group and a plurality of successive groups;

feeding said line in said longitudinal direction, transverse to said grain direction, toward a chipping tool, at an advancement speed, such that said leading group is cut by said chipping tool exerting a cutting force on said leading group;

applying a longitudinal compressive force in said longitudinal direction, in a manner such that said force urges said leading group by a successive group immediately succeeding said leading group, wherein said longitudinal compressive force exceeds said cutting force and braking the advancement speed of said leading group such that said leading group acts as an abutment to substantially absorb said longitudinal force.

2. The process as claimed in claim 1, wherein said longitudinal compressive force generates an adhesion, between said leading group and the successive group immediately succeeding said leading group, which exceeds said cutting force.

3. The process of claim 1, further comprising moistening mutually facing longitudinal edges of at least two of said successive groups sufficiently to increase adhesion between said at least two successive groups.

4. The process of claim 1, wherein said longitudinal force is applied such that the longitudinal compressive force at the interfaces between respective pairs of said wood groups increases along the line in the conveying direction.

5. The process of claim 1, wherein the longitudinal compressive force is initially applied to said successive groups by a conveying apparatus which acts directly, in the conveying direction, on at least one of said successive groups.

6. The process of claim 5, wherein said conveying apparatus applies a force having a first magnitude in the conveying direction on at least one of said successive groups and applies a force having a second magnitude in the conveying direction on at least one other of said successive groups, wherein said first magnitude is different than said second magnitude.

7. The process of claim 1, wherein a vertical compressive force is applied to the leading group upstream of the chipping tool, wherein said vertical compressive force acts over the height of the leading group.

8. The process of claim 7, wherein said feeding, said applying a longitudinal compressive force, and said braking the advancement speed of the leading group are performed so as to produce veneer strips or chipped wood of a given thickness, and wherein the vertical force terminates at a distance from the chipper tool which corresponds to between approximately one and two times said given thickness.

9. The process of claim 8, wherein said vertical compressive force has a selectable magnitude and further comprising a selecting of said magnitude.

10. The process of claim 7, wherein said vertical compressive force has a selectable magnitude and further comprising a selecting of said magnitude.

11. The process of claim 1, wherein a horizontal compressive force is applied to the leading group upstream of the chipping tool, wherein said horizontal compressive force acts over the height of the leading group.

12. The process of claim 11, wherein said horizontal compressive force has a selectable magnitude and further comprising a selecting of said magnitude.

13. The process of claim 11, wherein said feeding said line in said longitudinal direction, said applying a longitudinal compressive force, and said braking the advancement speed of the leading group are performed so as to produce veneer strips or chipped wood of a given thickness, and wherein the horizontal force terminates at a distance from the chipper tool which corresponds to between approximately one and two times said given thickness.

14. The process of claim 13, wherein said horizontal compressive force has a selectable magnitude and further comprising a selecting of said magnitude.

15. An apparatus for producing veneer strips or chipped wood, comprising:

a) a chipping tool;

b) a feed means for feeding a plurality of wood groups, each wood group being a stacked arrangement of planar wood pieces, toward said chipping tool, in manner such that plurality of wood groups are fed in a successive manner, along a line, and are spaced closely together, wherein said feed means includes a conveyor for conveying said plurality of said wood groups in an advancement direction, said advancement direction being a longitudinal direction toward the chipping tool, said conveyor being constructed and arranged to apply an advancement force in the advancement direction to at least one of said wood groups such that a leading group, which is the wood group most proximal to the cutting tool is urged, by at least one of the wood groups succeeding it, with a longitudinal compressive force, said conveyor further including i) an adjusting means for adjusting said longitudinal compressive force to exceed a cutting force to which the leading group is subjected by the chipping tool, and ii) a braking means for applying a braking force to said leading group at a location proximal to said cutting tool, said braking means having an adjustment means for adjusting said braking force so as to substantially absorb said longitudinal compressive force by said leading group acting as an abutment.

16. The apparatus of claim 15, wherein said braking means includes said conveyor being constructed and arranged to apply a first advancement force to at least one of said wood groups and a second advancement force to at least one other of said wood groups, said first advancement force having a magnitude different than said second advancement force, wherein the difference in magnitude is such that said leading group acts as a run-on brake by being braked in relation to one or more of its spatially succeeding wood groups.

17. The apparatus of claim 15, wherein the conveyor includes at least one of a chain, belt and roller conveyor.

18. The apparatus of claim 17, wherein the conveyor includes a plurality of overlapping conveying chains.

19. The apparatus of claim 15, wherein the conveyor is constructed and arranged to selectively urge at least one of said wood groups at a first advancement speed in the advancement direction and to selectively urge at least one other said wood groups at a second advancement speed in the advancement direction, and wherein the first advancement speed and the second advancement speed are independently selectable.

20. The apparatus as claimed in claim 15, wherein said braking means includes a clamping means having a vertically movable clamping bar upstream from and proximal to said chipping tool, constructed and arranged to selectively apply a vertical clamping force to said leading group.

21. The apparatus of claim 15, wherein said braking means includes a clamping means having contact-pressure bars upstream from and proximal to the chipping tool, on both sides of said feed line of said feed means, said contact-pressure bars constructed and arranged to be selectively movable in a horizontal direction, transverse to said feed line of said feed means, so as to selectively apply a horizontal compressive force.

22. The apparatus of claim 15, wherein said chipping tool rotates in a plane and said feed line of said feed means forms a non-zero angle relative to the normal of said plane, said angle being at least one of a horizontal and a vertical relative to said normal.

23. The apparatus of claim 22, wherein the feed means is constructed and arranged to feed at least two parallel lines of said wood groups to said cutting tool, and wherein said feed means includes at least one central partition wall extending in the feed direction.

24. The apparatus of claim 15, further comprising a feed conveyor arranged upstream of the feed means for transferring said wood groups to the feed means.

25. The apparatus of claim 15, wherein the chipping tool is disk-type chipper having rotating knives.

26. The apparatus of claim 25, wherein a stationary bridging bar is arranged immediately upstream of the disk-type chipper, approximately a few tenths of a millimeter upstream of the rotating knives.

27. The apparatus of claim 15, wherein the chipping tool is a knife-ring flaker.

* * * * *